US005731248A

United States Patent [19]

Phillips et al.

[11] Patent Number: 5,731,248

[45] Date of Patent: Mar. 24, 1998

[54] INSULATION MATERIAL

[75] Inventors: Bobby M. Phillips, Jonesborough; Jack L. Nelson, Johnson City, both of Tenn.

[73] Assignee: Eastman Chemical Company, Kingsport, Tenn.

[21] Appl. No.: 654,433

[22] Filed: May 28, 1996

Related U.S. Application Data

[62] Division of Ser. No. 510,950, Jul. 31, 1995, abandoned, which is a continuation of Ser. No. 311,998, Sep. 26, 1994, abandoned.

[51] Int. Cl.[6] ..... D04H 1/42; D04H 13/00; D01D 5/253

[52] U.S. Cl. ..... 442/335; 442/337; 442/340; 442/341; 442/350; 442/351; 428/397; 428/401

[58] Field of Search ..... 428/397, 401; 442/337, 335, 340, 341, 350, 351

[56] References Cited

U.S. PATENT DOCUMENTS

| | | | |
|---|---|---|---|
| 3,772,137 | 11/1973 | Tolliver . | |
| 4,136,222 | 1/1979 | Jonnes . | |
| 4,167,604 | 9/1979 | Aldrich . | |
| 4,304,817 | 12/1981 | Frankosky . | |
| 4,395,455 | 7/1983 | Frankosky . | |
| 4,681,789 | 7/1987 | Donovan et al. | 428/93 |
| 4,992,327 | 2/1991 | Donovan . | |
| 5,043,209 | 8/1991 | Boissé et al. . | |
| 5,057,368 | 10/1991 | Largman et al. | 428/397 |
| 5,102,711 | 4/1992 | Keller et al. . | |
| 5,277,976 | 1/1994 | Hogle et al. | 428/397 |

FOREIGN PATENT DOCUMENTS

WO93/02235 2/1993 WIPO .

*Primary Examiner*—Kathleen Choi
*Attorney, Agent, or Firm*—Cheryl J. Tubach; Harry J. Gwinnell

[57] ABSTRACT

Disclosed are fibrous structures comprised of shaped fibers wherein the thickness of the compressed fibrous structure at 1.00 psi is ≧1.3 times that of a similar compressed structure having the same area density and made from round cross section fibers of the same dpf as the shaped fibers. The invention is useful in articles such as coats, gloves, boats, shoes, etc. made using the structures disclosed herein. The surprising feature of structures according to the present invention is the thickness retention at high pressures. This retained thickness under pressure translates directly into decreased heat transfer or improved insulation.

13 Claims, 8 Drawing Sheets

COMPRESSION

INSULATION COMPARISON

EFFECTIVE THERMAL CONDUCTIVITIES

INSULATION MATERIAL

This is a divisional application of application Ser. No. 08/510,950, filed Jul. 31, 1995, now abandoned which is a file wrapper continuation of Ser. No. 08/311,998 filed Sep. 26, 1994 now abandoned.

TECHNICAL FIELD

This invention relates generally to insulation material. More particularly, this invention relates to fibrous structures, normally in the form of mats made from fibers, having a unique combination of softness and resistance to compression, i.e., ability to retain thickness when compressed under loads of typical use. These fibrous structures may be laminated to breathable sheet or film.

BACKGROUND OF THE INVENTION

The need for thermal insulation to protect against thermal extremes is well-known. Typically, intelligently designed structures are utilized to minimize the influence of thermal extremes. Outerwear for cold climates, gloves, boots, shoes, thermal underwear, etc. usually involve the use of insulation of some type. Natural insulation such as down or down/feather mixtures may be used or thin synthetic insulation such as Thinsulate (trademark), Thermoloft (trademark) or Microloft (trademark) may be used. These insulations all suffer from the inability to retain thickness when compressed under loads of typical use. The present invention provides structures which possess all of the advantages of advanced thin synthetic insulations and which have increased thickness retention when compressed.

Many patents exist on synthetic structures used for insulation. One advantage of synthetics lies in the retention of insulation value when wet. Down collapses when wet. Another advantage of the synthetics is the ability to design "thin" structures which offer significant protection without the large bulk of "downlike" structure. Ease of garment fabrication is another advantage of thin synthetics.

U.S. Pat. No. 4,304,817 discloses bats of crimped polyester fiber (<3 dpf), one component being slickened with a durable coating, one component being unslickened, and one component being a binder fiber. These bats may be used for apparel insulation.

U.S. Pat. No. 4,167,604 discloses a mixture of down and synthetic hollow staple fiber impregnated with a thermosetting resin. The utility is in sleeping bags, etc.

Various types of hollow fibers have been used in synthetic insulations. U.S. Pat. No. 3,772,137 discloses high loft structures made from hollow fibers and EPA 82303034.1 discloses improved hollow polyester fibers for softer insulation. The EPA fiber contains four continuous hollow sections with a total void fraction of 15 to 35%.

U.S. Pat. No. 4,395,455 discloses the use of thin layers of metal foils between layers of fibrous materials to reduce the radiation component of heat transfer in thermal insulation for apparel.

U.S. Pat. No. 4,992,327 discloses a cohesive fiber structure comprised of 70–90% of microfibers with a diameter of 3–12 microns, 5–30% of microfibers having a diameter of 12–50 microns wherein some of the fibers are bonded. Thermal conductivity like down are reported.

U.S. Pat. No. 4,136,222 discloses a thermally insulating sheet material comprised of a specularly reflecting film (open or closed to air) attached to a foam array covering only about 40 to 90% of the available area.

U.S. Pat. No. 5,102,711 discloses a self bonded nonwoven web and porous film composite where the nonwoven web is made from continuous filaments.

U.S. Pat. No. 5,043,209 discloses a laminated clothing liner comprised of a perspiration absorbing layer on the outside and a breathable film on the inside layer.

DESCRIPTION OF THE INVENTION

Figure 1A:
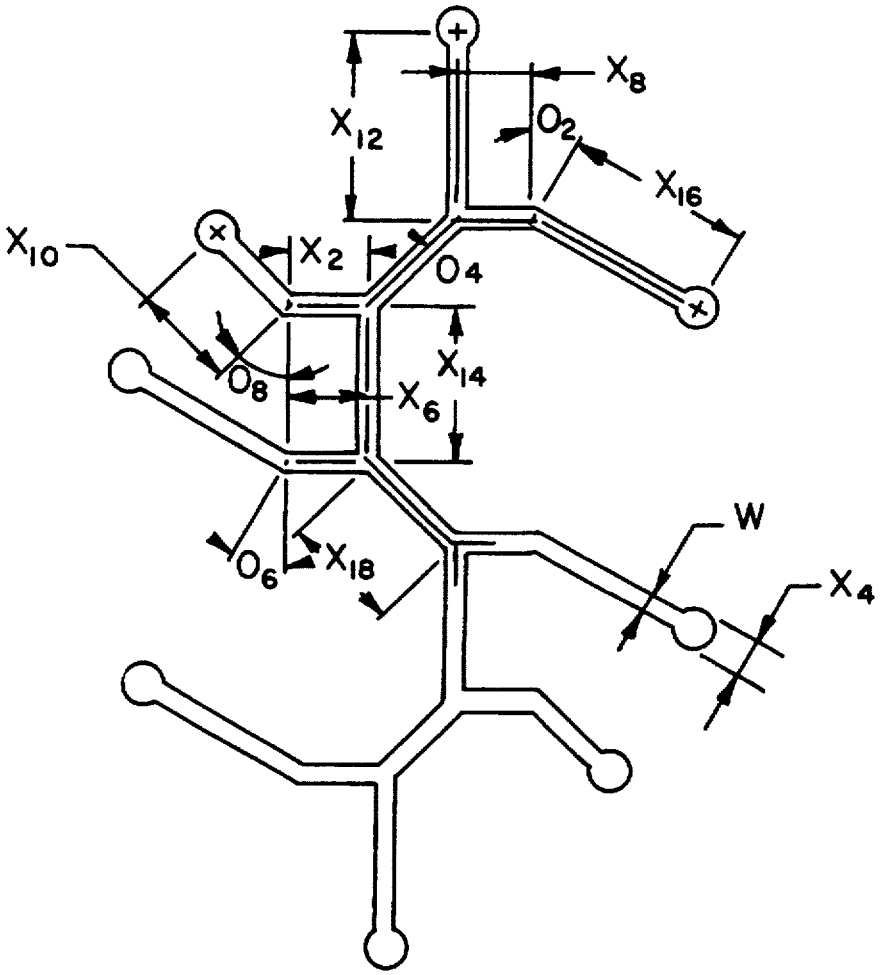
FIG. 1A is a schematic representation of a spinneret orifice used to produce the fiber shown in FIG. 1B.

According to the present invention, there are provided fibrous structures comprised of shaped fibers wherein the thickness of the compressed fibrous structure at 1.00 psi is $\geqq 1.3$ times that of a similar compressed structure having the same area density and made from round cross section fibers of the same dpf as the shaped fibers. The invention is useful in articles such as coats, gloves, boats, shoes, etc. made using the structures disclosed herein. The surprising feature of structures according to the present invention is the thickness retention at typical end use pressures (e.g., 1 psi). This retained thickness under pressure translates directly into decreased heat transfer or improved insulation.

The present invention is described as a thermally insulating structure comprising fibers wherein A) the softness of the structure is equal to or less than about 0.18 inch-pounds per square inch, B) the constant K in the expression % Compression=100-Kp is equal to or greater than 2.00 for the structure, C) the structure has an uncompressed density of about 0.3 to about 3.0 lb/ft$^3$ and an uncompressed thickness of less than 0.5 inch, D) the fibers in the structure have a plurality of fingerlike projections in cross section such that the shape factor is greater than 1.5, E) the fibers in the structure have a specific volume of about 1.5 to about 5.0 cc per gram and a denier of about 2 to about 15.

Softness is measured by the sum of the energy of (1) compression to 1 psi and (2) recovery to 0 psi.

$$\%\ \text{Compression} = \frac{\text{Initial Thickness of Structure Minus Final Thickness of Structure}}{\text{Initial Thickness of Structure}} \times 100$$

at 1 psi load.

P is the initial bulk density of the structure in lb/ft$^3$.

Shape factor is defined by the equation $$\text{Shape Factor} = \frac{\text{Perimeter of Fiber}}{\sqrt{4\pi \times \text{Cross Sectional Area of Fiber}}}$$

wherein the units of perimeter and area are consistent.

Specific volume is defined as the volume in cubic centimeters (cc) occupied by one gram of the fibers.

The specific volume of the yarn or tow made from the fiber is determined by winding the yarn or tow at a specified tension (normally 0.1 g/d) into a cylindrical slot of known volume. The yarn or tow is wound until the slot is completely filled. The weight of yarn contained in the slot is determined to the nearest 0.1 mg. The specific volume is then defined as:

$$\underset{@\ 0.1\ g/d}{\text{Specific Volume}} = \frac{\text{Volume of cylindrical Slot (cc)}}{\text{weight of yarn in the completely filled slot-gms}} = \frac{cc}{gms}$$

Thermally insulating mats of fibers are well known in the art. For example, batt-like arrays of fibers may be formed into a mat of predetermined thickness by conventional means such as, for example, onto a continuously moving belt. The fibers may be bonded together if desired using conventional adhesives, or preferably, needle punched using conventional procedures.

The fibers used in the thermally insulating mat according to this invention are of a particular configuration and have unique properties to result in a softness and resistance to compression especially suitable for insulation. The actual uncompressed thickness may vary from ~⅛ in. to ~½ in. depending on the end use and the severity of the environment to be encountered. The apparent thermal conductivity (measured as described hereinafter) is equal to or less than $$0.5\frac{\text{BTU in.}}{\text{Hr Ft}^2\ {}^\circ\text{F.}},$$

preferably less than $$0.4\frac{\text{BTU in.}}{\text{Hr Ft}^2\ {}^\circ\text{F.}}.$$

The fibers used in forming the structure of this invention are of a design which provides the softness and resistance to compression described above. The fibers have a plurality of finger-like projections in cross section such that the shape factor is greater than about 1.5. The finger-like projections extend lengthwise of the fibers. Several typical cross sections useful in the present invention are shown in the drawings.

Figure 1B:
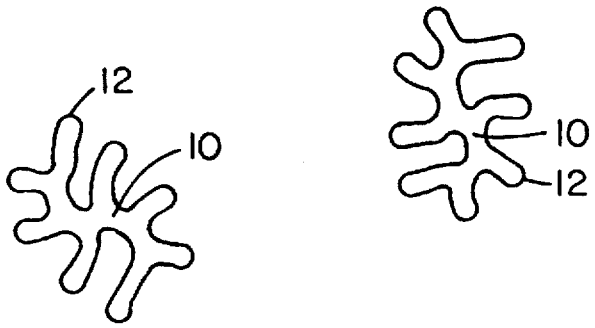
FIG. 1B is a cross section of a typical fiber used in the structures according to the present invention.
Figure 2:
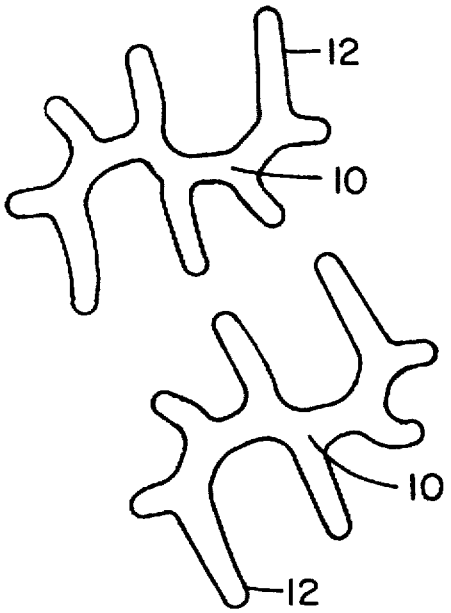
FIGS. 2–5 are sections of other typical fibers used in the structures according to the present invention.
Figure 3:
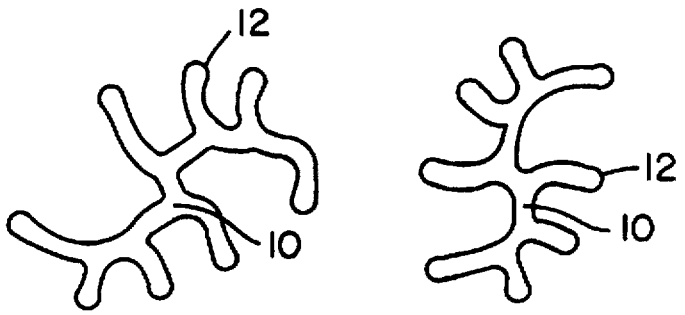
Figure 4:
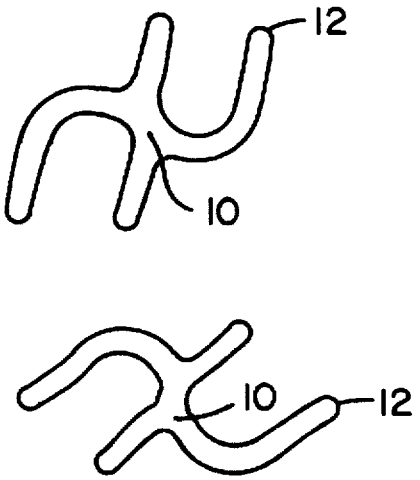
Figure 5:
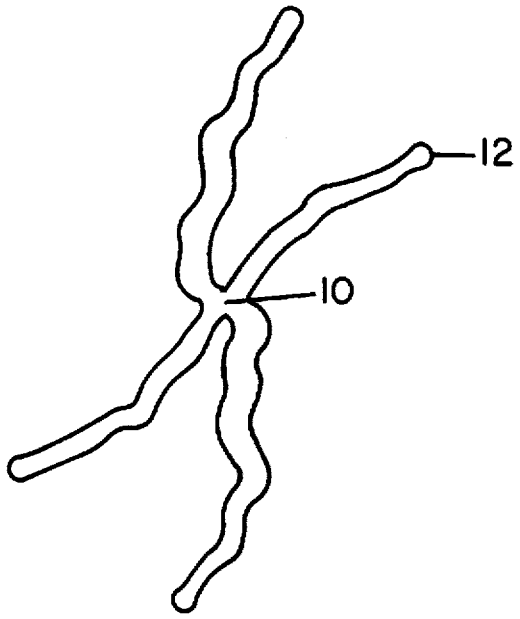

In FIG. 1B, a fiber cross section is illustrated wherein the body 10 of the fiber has a plurality of finger-like projections 12.

FIG. 1A is a schematic representation of a spinneret orifice used to produce the fiber shown in FIG. 1B. This description is illustrative of a typical spinneret, and is merely given as an example. Spinnerets for other shape fibers such as shown in FIGS. 2–5 can easily be designed by those skilled in the art. Therefore, spinnerets for those shapes need not be described herein.

As an example of a typical fiber produced according to this invention, poly(ethylene terephthalate) (PET) polymer of 0.6 I.V. is used. The polymer is dried to a moisture level of ≦0.003 weight percent in a Patterson Conaform dryer at 120° C. for a period of 8 hours. The polymer is extruded at 283° C. through an Egan extruder, 1.5-inch diameter, with a length to diameter ratio of 28:1. The fiber is extruded through an eight orifice spinneret wherein each orifice is as shown in FIG. 1A wherein W is 0.100 mm, $X_2$ is 4 W, $X_4$ is 2 W, $X_6$ is 6 W, $X_8$ is 6 W, $X_{10}$ is 7 W, $X_{12}$ is 9 W, $X_{14}$ is 10 W, $X_{16}$ is 11 W, $X_{18}$ is 6 W, $\theta_2$ is 0°, $\theta_4$ is 45°, $\theta_6$ is 30°, and $\theta_8$ is 45°. The polymer throughput is about 7 pounds (lb)/hour. The air quench system has a cross-flow configuration. The quench air velocity at the top of the screen is an average of 294 feet (ft)/minute. At a distance of about 7 inches from the top of the screen the average velocity of the quench air is about 285 ft/minute, and at a distance of about 14 inches from the top of the screen the average quench air velocity is about 279 ft/minute. At about 21 inches from the top of the air screen the average air velocity is about 340 ft/minute. The rest of the screen is blocked. Fibers of 15 dpf (denier per filament) are wound at 1,500 meters per minute (MPM) on a Lessona winder. A photomicrograph of a cross-section of this fiber is shown in FIG. 1B.

These fibers are then processed on conventional polyester staple processing equipment using a first stage draft of 2× in water at 70° C., a second stage draft of 1.25× in steam at 180° C. The fiber is then crimped conventionally, a hydrophilic lube is applied, and then allowed to dry for 5 minutes in an oven at 145° C. The tow is then cut to the desired staple length.

FIGS. 2–5 illustrate different cross sections which provide insulation characteristics of the present invention. FIGS. 2, 3, 4 and 5 illustrate fibers having bodies 10 and finger-like projections 12. These fibers have shape factors of about 3.15, 3.8, 2.9 and 3.8 respectively.

The fibers used in the structure of the present invention may be of any composition which can be formed into the shape described above and have the characteristics described above. For example, the composition may be synthetic or natural polymer. Of special interest are the organic polymers, such as polyesters, polyamides, cellulose acetate, cellulose acetate propionate, and cellulose acetate butyrate. Of these, polyesters, particularly polyethylene terephthalate as described in the above example, polycyclohexylenedimethylene terephthalate and copolymers of these polyesters are particularly desirable.

As used herein, the inherent viscosity (I.V.) is measured at 25° C. using 0.50 g of polymer per 100 mL of a solvent consisting of 60% by weight phenol and 40% by weight tetrachloroethane.

The methodology for compression testing of mats using the Sintech (trademark) 2W machine is described as follows:

1. Samples are precut to a size which accommodates the testing platform (10 in.×10 in., 12 in.×12 in.).

2. The sample is placed on the platform beneath the testing foot of known dimension (2.25 inch diameter).

3. The compression apparatus is set up with the following parameters:

a. gage length, determined by the initial thickness of the fabric (2 inches)

b. crosshead speed, 2 inches per minute c. load cell, appropriate for the peak loading (5 pounds or 50 pounds)

d. peak load, maximum force achieved at elongation (1 pound or 5 pounds per square inch)

e. slack load, load at which initial thickness of fabric is determined (30 grams)

f. return load, load at which the final thickness of fabric is determined (30 grams)

g. hold time, time peak load is held (60 seconds)

4. The testing is begun and multiple cycles can be performed at a single site on the sample. Multiple sites on the same sample can also be tested.

Apparent thermal conductivity measurements on nonwovens using a Holometrix (trademark) heat flow meter thermal conductivity instrument is described as follows:

A Holometrix Model K50/K75 K-Matic heat flow meter thermal conductivity instrument is used to measure the K-factor or thermal conductivity of nonwovens made from different types of fibers. The instrument is manufactured by Holometrix, Inc., Thermatest Instruments Division. The instrument is turned on and allowed to warm up overnight before calibration and sample testing is conducted. The instrument is calibrated at the beginning of each testing day and is left on for the duration of multi-day testing periods. Two 1-inch thick glass fiber composite calibration samples having thermal conductivities of 0.253 and 0.256 BTU-IN/(HR-FT2-DEGF) are supplied by the manufacturer for calibrating the instrument. In general, the calibration is stable from day to day within ±0.003 (or less) BTU-IN/(HR-FT2-DEGF). Nonwoven samples 12-inch by 12-inch are layered to sufficient thickness to meet the instrument manufacturer's requirement that the sample thickness in inches be no less than twice the expected value of thermal conductivity measured in BTU-IN/(HR-FT2-DEGF). The instrument, designed to conform to ASTM C518 standards, consists of an insulated chamber having a heated lower surface and a cooled upper surface between which samples are placed for testing. The lower surface is movable by means of an external lever arm to bring the sample in contact with the upper surface and, if desired, to effect some compression of the sample. Digital readout of thermal conductivity, sample thickness, heat flow rate, and temperature difference between the upper and lower plates are provided by means of a selector switch on the front of the instrument. An external digital readout of the upper and lower plate temperatures is also provided. Samples are placed in the chamber and allowed to reach equilibrium prior to logging data. Equilibrium is defined as no detectable change in thermal conductivity readout in at least a five minute period. Generally, equilibrium is reached in 30 to 60 minutes, depending on the total mass and thickness of the sample. The following two carded thermally bonded, 6 oz/yd$^2$ bats are made for comparative testing:

| | |
|---|---|
| | 1) Control Bat |
| 85 wt % | Polyethylene terephthalate (I.V. = 0.60) fiber, 6.5 dpf, 2.0 inch length |
| 15 wt % | Sheath/Core fiber - Sheath is low melting polyethylene terephthalate modified with a comonomer such as 1,4-cyclohexane-dimethanol or diethylene glycol (I.V. = ~0.60); core is polyethylene terephthalate (I.V. = 0.60); 6.5 dpf, 2.0 in. length |
| | 2) Bat According to Invention |
| 85 wt % | Polyethylene terephthalate (I.V. = 0.62) fiber, dpf = 6.0, 3.0 in. length |
| 15 wt % | Sheath/core fiber (same as in Control) |

TABLE 1

Fiber Properties

| Property | According to Invention | Control |
|---|---|---|
| Shape Factor | 2.7 | 1.0 |
| Cross Section | Shown in FIG. 1 | Round |
| Channel area as a % of circumscribed area | 40% | 0 |

Figure 6:
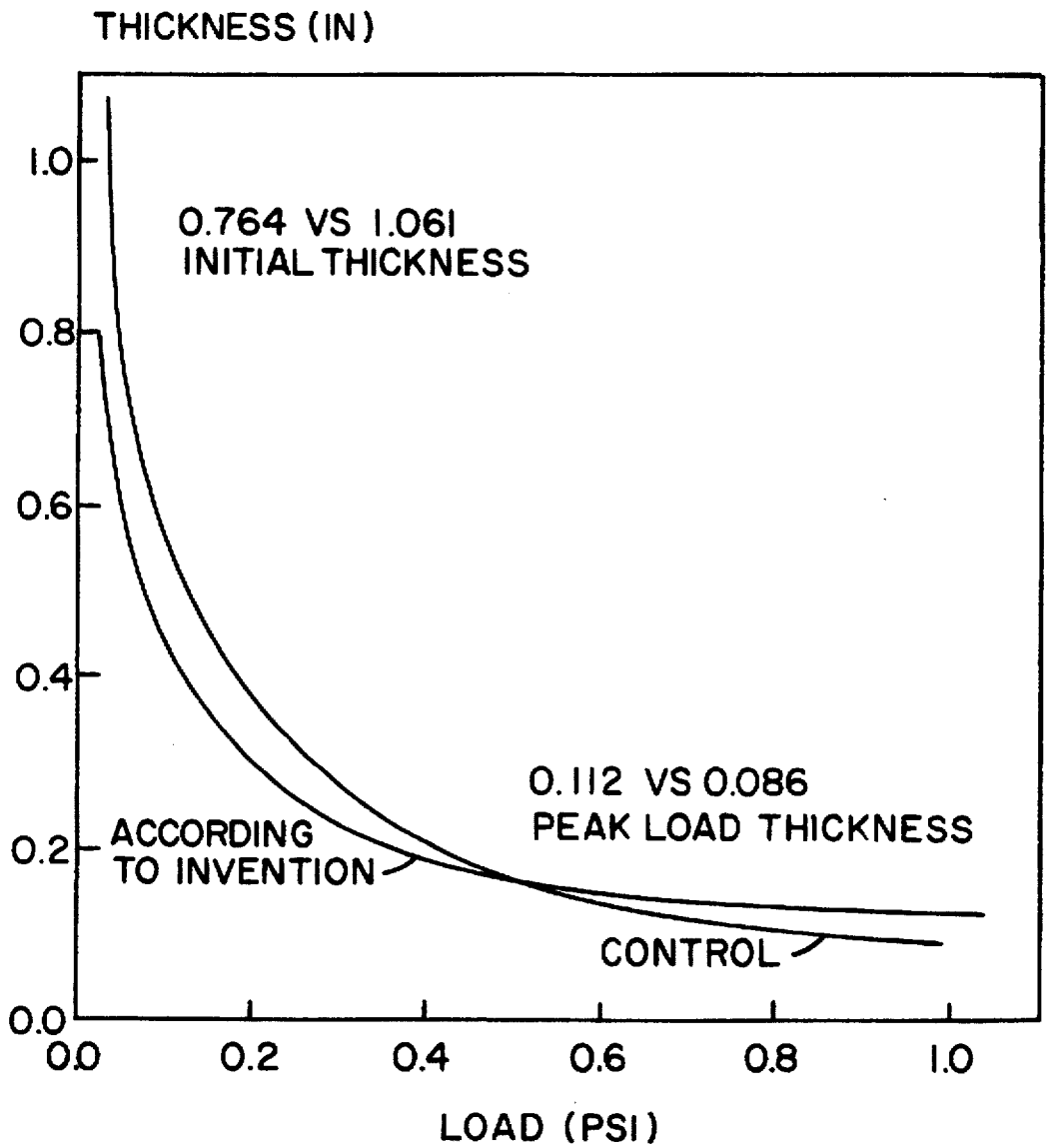
FIGS. 6, 7 and 8 are graphs comparing the resistance to compression, insulating properties and thermal conductivity of the structures in accordance with the present invention to a control respectively.
Figure 7:
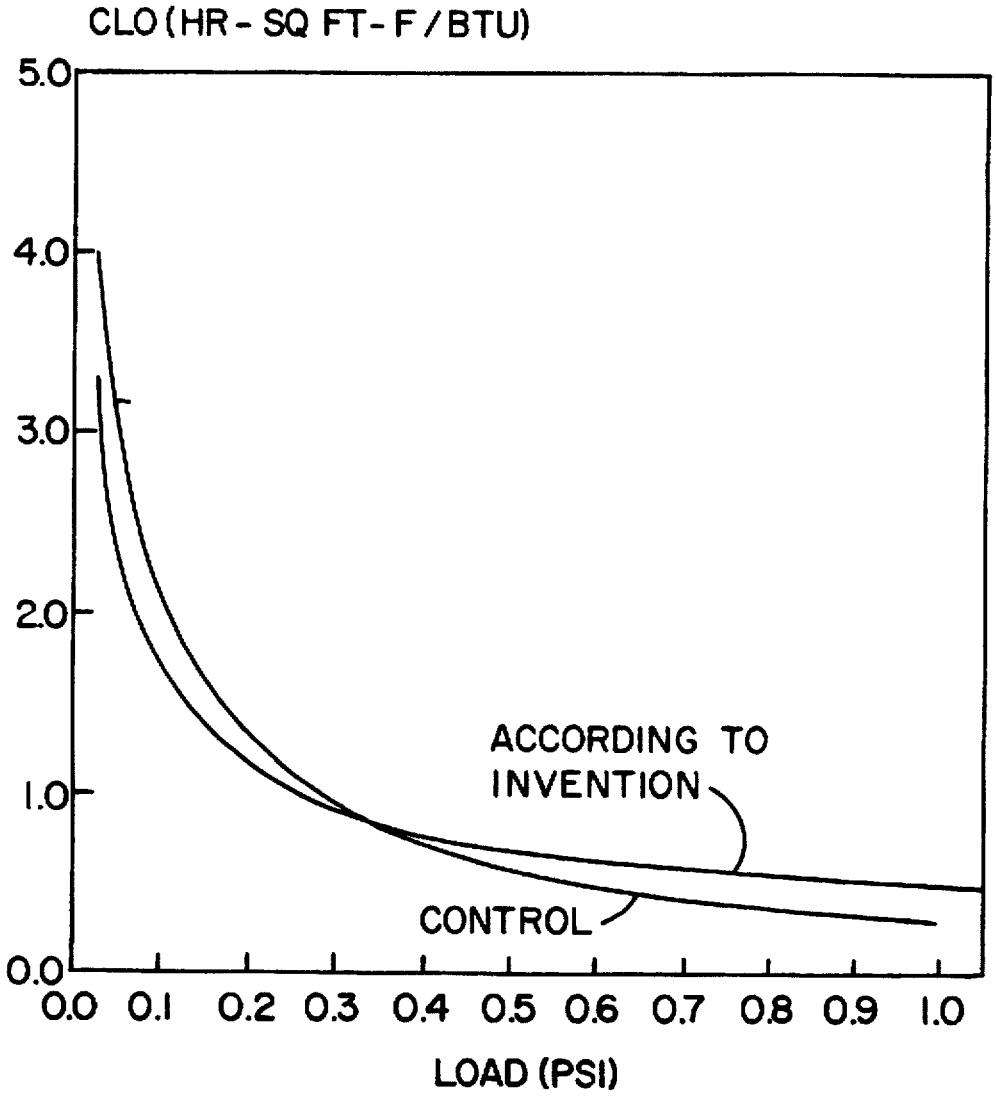
Figure 8:
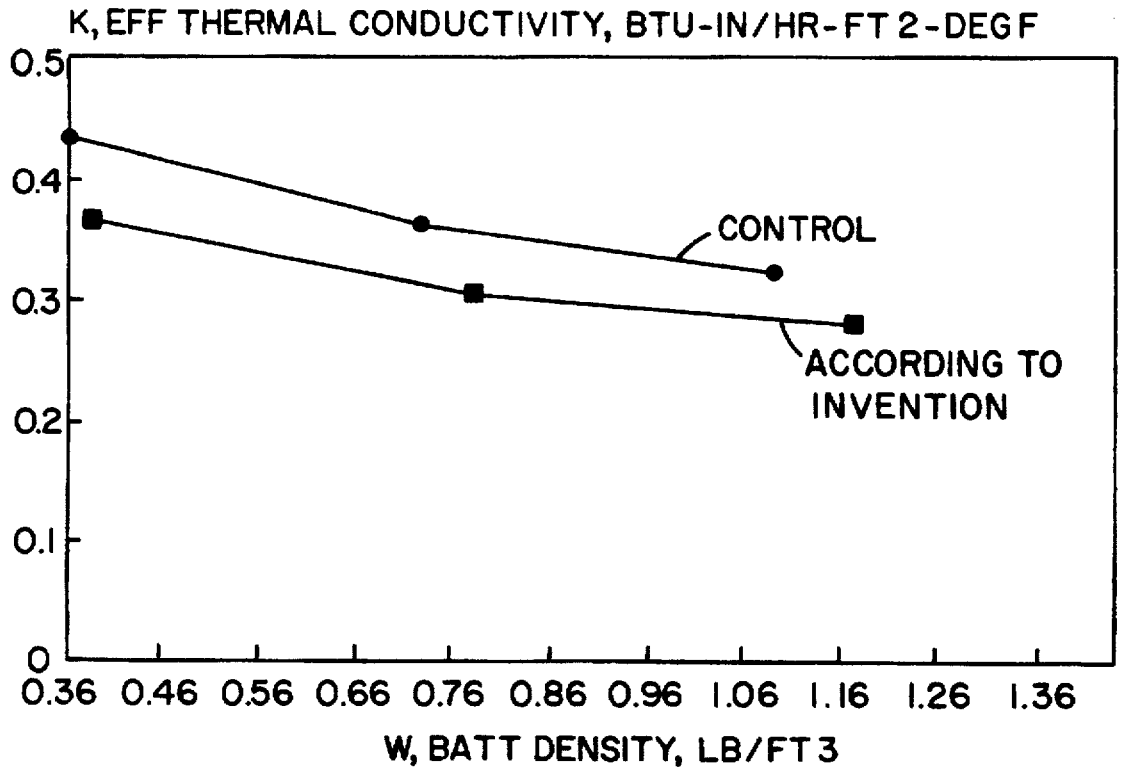

FIG. 6 shows the compression character of these 2 bats up to 1 psi load. Notice the initial thickness of the Control bat is greater (more lofty, lower density) than the bat according to the invention. However, under a load of 1 psi, the retained thickness is 30% (1.30 times) greater for the bat according to this invention than for the control bat while maintaining essentially the same softness and suppleness. This translates into the advantage in insulation shown in FIG. 7. FIG. 8 shows the apparent thermal conductivities of the bats as a function of density. The standard definition of CLO was used in FIG. 7. The softness of this sample is ~0.16 inch-lbs/in.$^2$.

Figure 9:
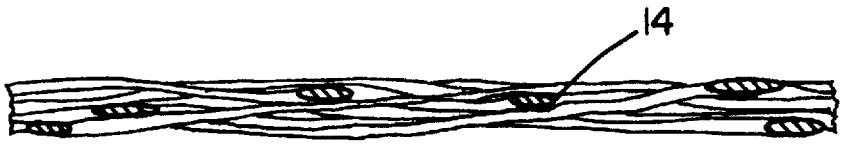
FIGS. 9 and 10 are cross sectional views of a fibrous structure in the form of a nonwoven web and laminate respectively.

FIG. 9 illustrates in cross section a nonwoven mat of fibers 14 for insulation material according to this invention.

Figure 10:
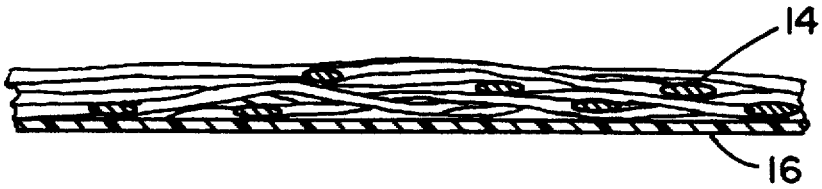

FIG. 10 illustrates in cross section a nonwoven mat of fibers 14 laminated to a breathable sheet 16 for insulation material according to this invention. As an example, a laminate of Gore-Tex (trademark) breathable sheet material and a layer of nonwoven fibers are adhesively bonded to form insulating material according to this invention. The layer of nonwoven fibers is 3/16 inch thick and the fibers therein are 6 dpf and 2 inches long. Bulk density is 0.5 lb/ft$^3$. Shape factor of the fibers is 2.7. The fibers are capable of spontaneously transporting fluids such as perspiration. By "spontaneously transporting" fluids, it is meant the behavior of a fluid in general and in particular a drop of fluid, typically water, when it is brought into contact with a single fiber such that the drop spreads along the fiber. Such behavior is contrasted with the normal behavior of the drop which forms a static ellipsoidal shape with a unique contact angle at the intersection of the liquid and the solid fiber. It is obvious that the formation of the ellipsoidal drop takes a very short time but remains stationary thereafter. The key factor is the movement of the location of the air, liquid, solid interface with time. If such interface moves just after contact of the liquid with the fiber, then the fiber is spontaneously transportable; if such interface is stationary, the fiber is not spontaneously transportable. The spontaneously transportable phenomenon is easily visible to the naked eye for large filaments (>20 denier per filament (dpf) but a microscope may be necessary to view the fibers if they are less than 20 dpf. Colored fluids are more easily seen but the spontaneously transportable phenomenon is not dependent on the color. It is possible to have sections of the circumference of the fiber on which the fluid moves faster than other sections. In such case the air, liquid, solid interface actually extends over a length of the fiber. Thus, such fibers are also spontaneously transportable in that the air, liquid, solid interface is moving as opposed to stationary. Such fibers are disclosed in the art, for example, U.S. Pat. Nos. 5,268,229; 4,707,409 and 5,200,248 which are incorporated herein by reference.

By the term "breathable film", we mean a film or sheet of material which is capable of passing water vapor but is impervious to liquid water. Examples include well known Gore-Tex sheet material and Dermoflex (trademark) sheet material.

The invention has been described in detail with particular reference to preferred embodiments thereof, but it will be understood that variations and modifications can be effected within the spirit and scope of the invention.

We claim:

1. A fibrous structure made from shaped fibers wherein the thickness of a compressed said fibrous structure made from said shaped fibers at 1.0 psi is ≧1.3 times that of the same compressed fibrous structure having the same area density and made from round cross section fibers, and wherein said shaped fibers have a denier ≦7 and a shape factor ≧2.00, and said fibrous structure made from shaped fibers has an uncompressed density between 0.3 $lbs/ft^3$ and 4 $lb/ft^3$ and a thickness ≦½ inch.

2. The fibrous structure made from shaped fibers of claim 1 wherein the thickness of said compressed fibrous structure made from said shaped fibers is between 1.3 times and 2.5 times that of the same compressed fibrous structure having the same area density and made from round cross section fibers.

3. The fibrous structure made from shaped fibers of claim 1 wherein said shaped fibers are thermally bonded.

4. The thermally bonded fibrous structure of claim 3 wherein a bonding agent is less than 30% by weight of said thermally bonded fibrous structure.

5. The fibrous structure made from shaped fibers of claim 1 which is needle punched.

6. The fibrous structure made from shaped fibers of claim 1 which is carded.

7. The fibrous structure made from shaped fibers of claim 1 which is a staple yarn.

8. The fibrous structure made from shaped fibers of claim 1 wherein a major component is selected from the group consisting of polyethylene terephthalate, polypropylene and nylon.

9. The fibrous structure made from shaped fibers of claim 1 wherein the shape factor is between 2.4 and 7.0.

10. The fibrous structure made from shaped fibers of claim 8 wherein the shape factor of the major component is between 2.4 and 7.0.

11. An insulation for shoes or boots comprising the fibrous structure made from shaped fibers of claim 1.

12. An insulation for apparel comprising the fibrous structure made from shaped fibers of claim 1.

13. A laminate wherein one of the components is the fibrous structure made from shaped fibers of claim 1.

* * * * *